US009293877B2

(12) United States Patent
Wong et al.

(10) Patent No.: US 9,293,877 B2
(45) Date of Patent: Mar. 22, 2016

(54) INTERFACE ADAPTER

(71) Applicant: AASTRA TECHNOLOGIES LIMITED, Concord (CA)

(72) Inventors: James T. Wong, Concord, CA (US); Bratislav Marjanovic, Concord, CA (US)

(73) Assignee: Mitel Networks Corporation, Ottawa (CA)

( * ) Notice: Subject to any disclaimer, the term of this patent is extended or adjusted under 35 U.S.C. 154(b) by 30 days.

(21) Appl. No.: 14/143,319

(22) Filed: Dec. 30, 2013

(65) Prior Publication Data

US 2014/0187070 A1 Jul. 3, 2014

Related U.S. Application Data

(60) Provisional application No. 61/747,724, filed on Dec. 31, 2012.

(51) Int. Cl.

| | |
|---|---|
| ***H01R 24/00*** | (2011.01) |
| ***H01R 31/06*** | (2006.01) |
| ***H01R 43/26*** | (2006.01) |
| ***H01R 24/64*** | (2011.01) |
| *H01R 27/00* | (2006.01) |

(52) U.S. Cl.

CPC ..... *H01R 31/06* (2013.01); *H01R 24/64* (2013.01); *H01R 43/26* (2013.01); *H01R 27/00* (2013.01); *Y10T 29/49208* (2015.01)

(58) Field of Classification Search

CPC ..... H01R 27/00; H01R 24/64; H01R 31/06; H01R 43/26; Y10T 29/49208

USPC ..... 439/284, 676

See application file for complete search history.

(56) References Cited

U.S. PATENT DOCUMENTS

| | | | | |
|---|---|---|---|---|
| 4,921,442 | A | 5/1990 | Puerner | |
| 7,892,012 | B1 | 2/2011 | Foung | |
| 8,632,352 | B2 * | 1/2014 | Wagner | 439/352 |
| 2001/0018287 | A1 | 8/2001 | Reichle | |
| 2006/0009083 | A1 | 1/2006 | Liao | |

FOREIGN PATENT DOCUMENTS

| | | | |
|---|---|---|---|
| DE | 9106764 | U1 | 8/1991 |
| WO | WO 2012/098538 | A1 | 7/2012 |

* cited by examiner

*Primary Examiner* — Khiem Nguyen

(57) ABSTRACT

An apparatus for use with a first RJ-type female receptacle having an open, plug receiving end and an internal cavity, the first RJ-type female receptacle designed to receive a corresponding first modular mating RJ-type male plug, the apparatus having: a housing having a front face, a top wall, a bottom wall and side walls defining an opening formed within the front face; and the apparatus received in the first RJ-type female receptacle, and the opening dimensioned to receive a second modular mating RJ-type male plug, wherein the second modular mating RJ-type male plug is dimensioned smaller than the first modular mating RJ-type male plug.

20 Claims, 4 Drawing Sheets

INTERFACE ADAPTER

CROSS-REFERENCE TO RELATED APPLICATIONS

This application claims the benefit of priority to U.S. Provisional Application Ser. No. 61/747,724 filed on Dec. 31, 2012.

FIELD OF THE INVENTION

The present invention relates to communication interface adapters.

DESCRIPTION OF THE RELATED ART

A modular receptacle jack, or registered jack (RJ) connector, is commonly used in telecommunications and data networking equipment. An RJ connector typically forms a link between two pieces of equipment to provide a means of communication between them. There exists a plurality of RJ connectors, each specific to a particular network interface, such as, RJ2MB, RJ11(C/W), RJ12(C/W), RJ13(C/W), RJ14 (C/W), RJ15C, RJ18(C/W), RJ21X, RJ25(C/W), RJ26X, RJ27X, RJ31X, RJ32X, RJ33X, RJ34X, RJ35X, RJ38X, RJ41S, RJ45S, RJ48C, RJ48S, RJ48X, RJ49C, RJ61X, and RJ71C. As an example, a RJ45 connector is specified by standard IEC 603-7, and comprises 8 terminals or pin-outs, while a RJ11 connector comprises 2 terminals, and a RJ14 connector comprises 4 or 6 terminals.

Generally, jacks on products today are designed to interface or mate only with a corresponding header connected to a cable or wire. For example, an RJ45 female connector on a network product interfaces with an RJ45 header on a network cable. However, it is often desirable to connect a different or smaller header into a larger or different connector. The problem with this situation is that the smaller/different header does not always fit securely inside the larger female connector or the pins between the connector and header do not align properly and do not make proper electrical contact. For example, if an RJ45 female connector is present on a network product and it is desired to connect a smaller RJ9 header into the RJ45 connector, then RJ9 header may be loose, misaligned, and will not make proper electrical contact with the desired pins. One solution has been to create a separate part that is not installed in the product or use multiple connectors on their products to provide the same functionality; however this increases equipment costs and results in increased maintenance costs.

It is an object of the present invention to mitigate or obviate at least one of the above-mentioned disadvantages.

SUMMARY OF THE INVENTION

In one of its aspects, there is provided a communication interface adapter having:

a top wall, bottom wall, opposing walls defining an opening;

a lip extending from said top wall;

a tab extending from each of said opposing side walls; and a pair of arms extending from said opposing side walls and adjacent to said top wall.

In another of its aspects, there is provided an apparatus for use with a first RJ-type female receptacle having a plug receiving end with an internal cavity, said first RJ-type female receptacle designed to receive a corresponding first modular mating RJ-type male plug, the apparatus having:

a housing having a front face, a top wall, a bottom wall and side walls defining an opening formed within said front face; and said apparatus received in said first RJ-type female receptacle, and said opening dimensioned to receive a second modular mating RJ-type male plug, wherein said second modular mating RJ-type male plug is dimensioned smaller than said first modular mating RJ-type male plug.

In another of its aspects, there is provided a method of coupling a first RJ-type female receptacle of a first size and a second RJ-type connector of a second size, wherein said first RJ-type female receptacle and second RJ-type connector correspond to different communication interface, the method comprising the steps of:

providing a communication interface adapter received within said first RJ-type female receptacle;

anchoring said communication interface adapter within a keyway of said first RJ-type female receptacle; said communication interface adapter providing a desired mechanical alignment and electrical pin alignment of said second RJ-type connector within said first RJ-type female receptacle.

Advantageously, the interface adapter allows different headers to interface with a common connector, thus allowing manufacturers to reduce the number of independent connectors required on their products and lower product component costs. Also, the adapter allows manufacturers to consolidate the number of connectors required on their products by combining two or more connectors into one. The adapter secures different types of interface headers physically and ensures electrical contact. In addition, the adapter may be sold as a stand-alone part or installed on an existing product available on the market.

BRIEF DESCRIPTION OF THE DRAWINGS

Several preferred embodiments of the present invention will now be described, by way of example only, with reference to the appended drawings in which.

DETAILED DESCRIPTION OF EXEMPLARY EMBODIMENTS

The detailed description of exemplary embodiments of the invention herein makes reference to the accompanying block diagrams and schematic diagrams, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Indeed, for the sake of brevity, certain sub-components of the individual operating components, conventional data networking, application development and other functional aspects of the systems may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

Figure 1:
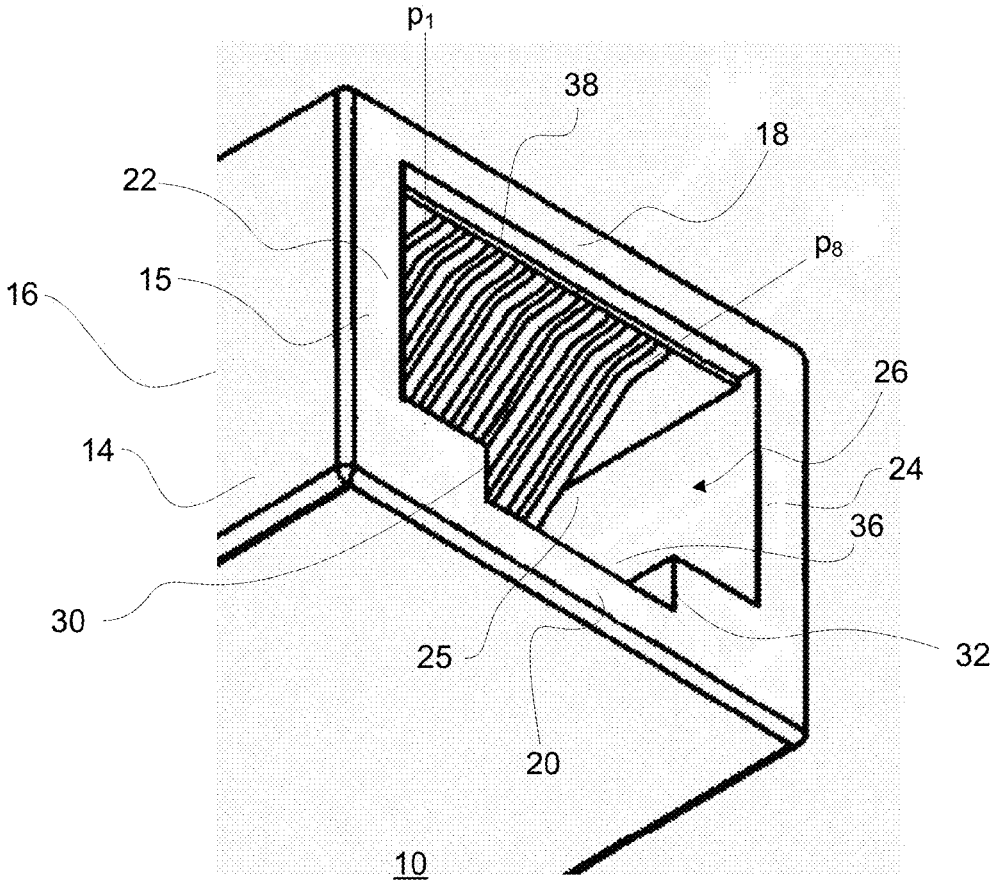
FIG. 1 shows a schematic diagram of an RJ45 female receptacle, in a preferred embodiment.
Figure 2:
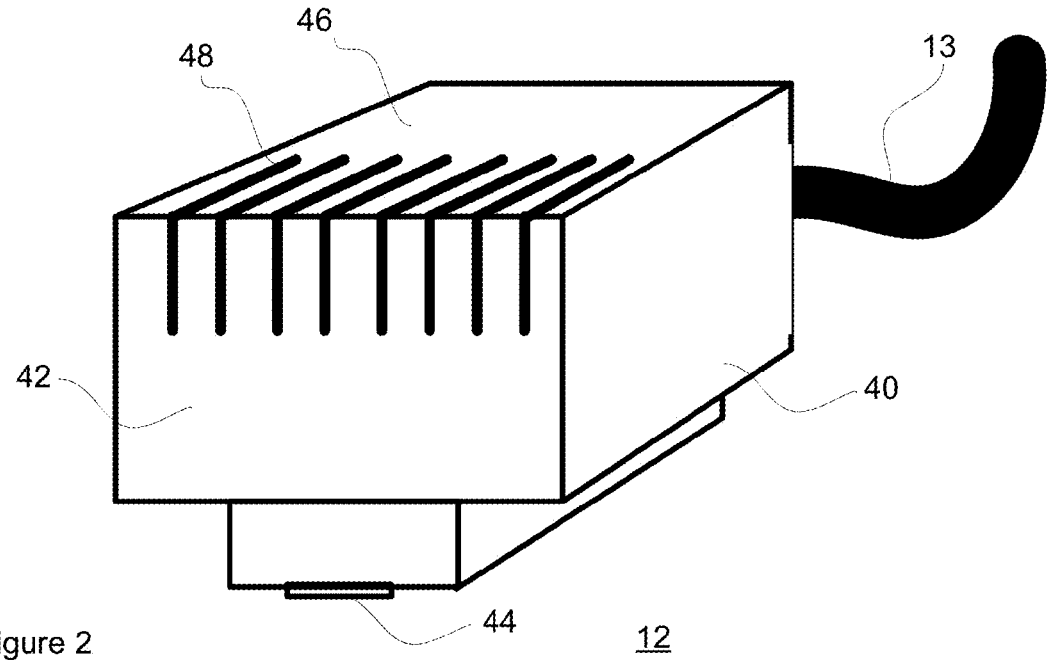
FIG. 2 shows a schematic diagram of an RJ45 male plug.

FIGS. 1 and 2 shows a connector or female receptacle 10 for receiving a header or male plug 12 secured at a distal end of a cable 13. The female receptacle 10 provides a communication interface to a computing device or network apparatus, such as a computer, modem or router. Typically, the female receptacle 10 may be electrically coupled to a circuit board associated with the computing device or network apparatus. The female receptacle 10 and the male plug 12 are of the RJ-type.

As can be seen in FIG. 1, the female receptacle 10 includes a one-piece moulded plastic housing 14 having a front face 15, a rear wall 16, a top wall 18, a bottom wall 20 and side walls 22 and 24 to form a cavity 25. The rear wall 16 extends transversely across the rear portion of the housing 14. It should be understood that the designation of wall as a "top" wall is made with respect to the view of the housing illustrated in FIG. 1, but that, in use, top wall may, in fact, be oriented as a bottom wall. The designations "top" and "bottom" are therefore made for ease of explanation of the invention, and should not be interpreted as limiting in any way.

An opening 26 formed in the front face 15 is adapted to receive the modular mating male plug 12. Spaced apart shoulders 30 and 32 define substantially rectangular, elongated recess 36 or keyway extending from the front face 15 rearwardly along the bottom wall 20 towards the rear wall 16.

A plurality of apertures or holes is formed in alternating positions in the top wall 18, and extends from the rear wall 16 to the front face 15. The apertures are adapted to receive portions of conductor wires 38, or female receptacle contacts. The female receptacle contacts 38 extend through housing 14 in a side-by-side, spaced apart fashion, and may be round, rectangular, or stamped metallic parts. The female receptacle contacts 38 include spring contact portions which move under spring contact pressure applied by the contacts of mating plug 12.

The male plug 12 of a conventional design generally includes a dielectric housing 40 having a free end or front face 42 for insertion into the opening 26 of the housing 14, a resilient locking tab 44 integrally connected by a flexible hinge to the free end 42 of the dielectric housing 40 and extending obliquely rearwardly therefrom. The modular mating plug 12 also includes a terminal receiving side 46 having partitions which define side-by-side slots in which substantially flat, electrically conductive contact terminals 48, or male plug contacts, are positioned.

As described above, the male plug 12 is received by the aperture 26 of the female receptacle 10, and secured with the female receptacle 10 by the resilient locking tab 44 with a releasable locking mechanism that engages the keyway 36. As the male plug 12 is inserted, the male plug contacts 48 push against the spring contact portions of female receptacle contacts 38, thus establishing an electrically conductive connection.

In the description above, the female receptacle 10 and the male plug 12 are of the RJ45 type, and therefore complement each other. Any attempt to introduce a smaller-sized RJ-type header, such as an RJ11 male plug, would result in a loose fit of the RJ11 male plug 12 within the much larger cavity 25 of the RJ45 female receptacle 10. As a result of the ill-fit, the releasable locking mechanism of the smaller-sized RJ-type fails to engage the keyway 36, therefore the male plug contacts 74 are thus not able to push against the spring contact portions of female receptacle contacts 38, resulting in a lack of electrical conductivity between the female receptacle contacts 38 and the contacts of the RJ11 male plug 12.

Figure 3A:
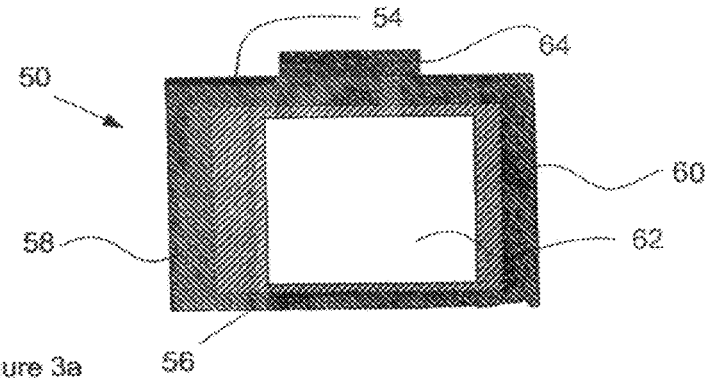
FIG. 3*a* shows a front view of an adapter for insertion in the RJ45 female receptacle.
Figure 3B:
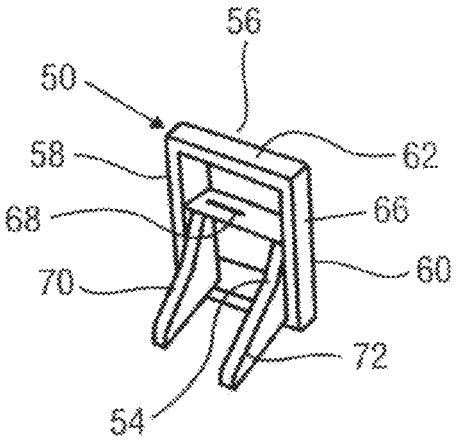
FIG. 3*b* shows another view of the adapter of FIG. 3*a;*
Figure 3C:
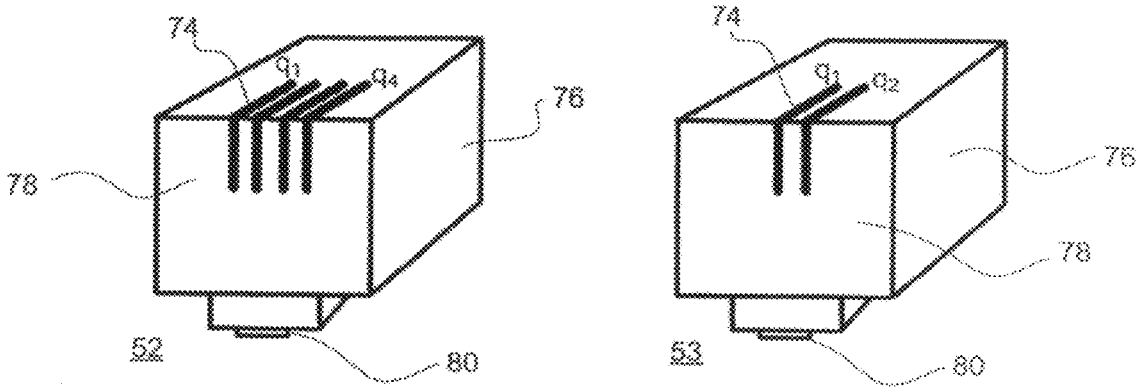
FIG. 3*c* shows exemplary RJ14 and RJ11 male plugs.
Figure 4A:
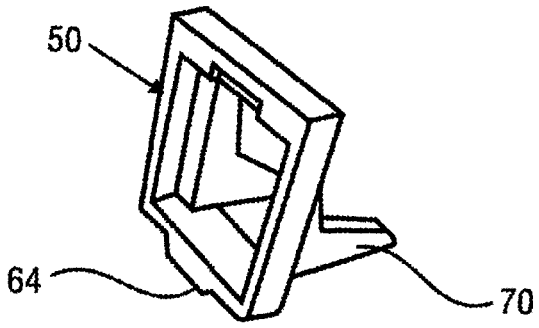
FIGS. 4*a*, 4*b*, and 4*c* show other views of the adapter of FIG. 3*a*.
Figure 4B:
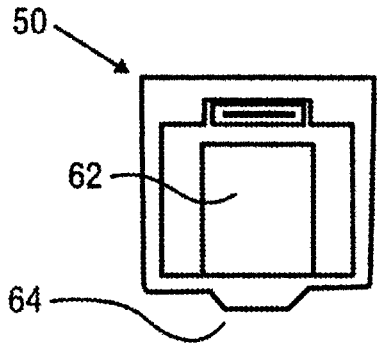
Figure 4C:
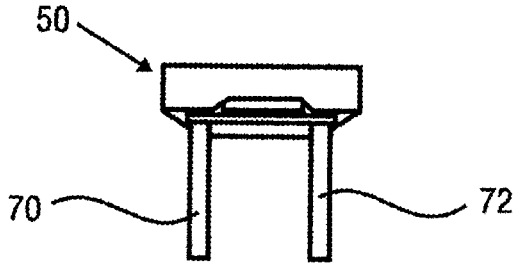
Figure 5:
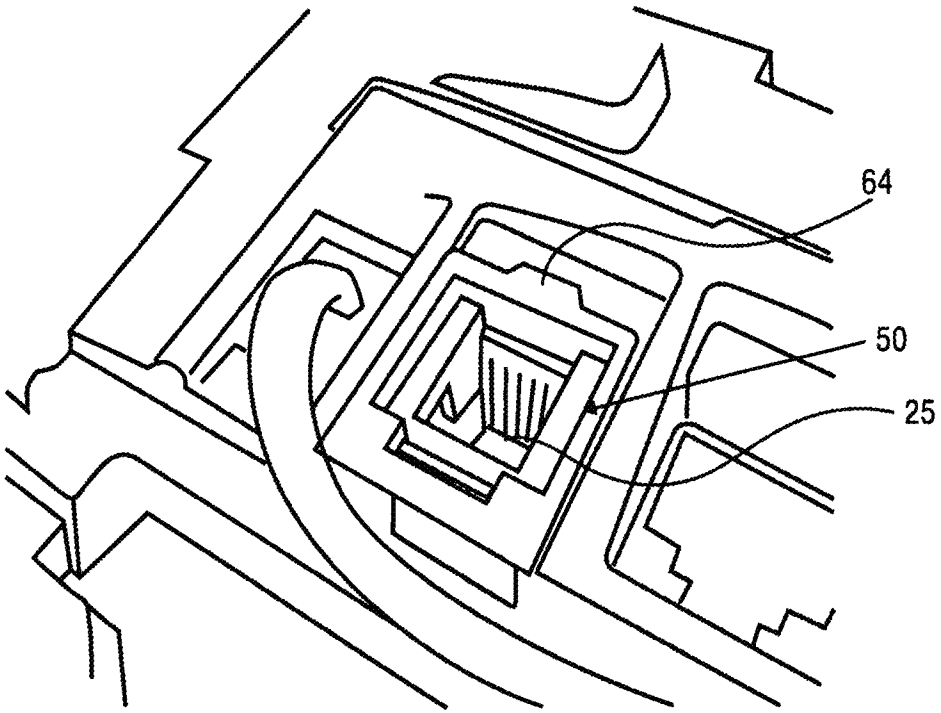
FIG. 5 shows the adapter of FIG. 3*a* resident within the RJ45 female receptacle of FIG. 1.

FIGS. 3*a* and 3*b* show an interface adapter 50 that allows a smaller-dimensioned RJ-type male plug, such as an RJ14 plug 52 or an RJ11 plug 53, as shown in FIG. 3*c*, to be inserted and secured with a larger cavity 25 of an RJ45 female receptacle 10. The interface adapter 50 is an integral moulded part comprising a top wall 54, a bottom wall 56 and side walls 58 and 60. An opening 62 is formed in the front wall 14 and is dimensioned to receive a smaller-dimensioned RJ-type male plug, such as an RJ14 male plug 52 or an RJ11 male plug 53. The top wall 54 includes a lip 64 integrally formed therewith, and the about midway of the side walls 58 and 60 are tabs 66, 68 extending therefrom, respectively. At the corners where the side walls 58, 60 and the top wall 54 meet are a pair of arms 70, 72 extending therefrom. FIGS. 4*a*, 4*b* and 4*c* show other views of the adapter 50. On inserting the adapter 50 into the cavity 25, while the tabs 66, 68 engage the side walls 22, 24, and the arms 70, 72 travel adjacent the top wall 18 of the RJ45 female receptacle 10 and towards the rear wall 16. Accordingly, the arms 70, 72 push against the spring contact portions of female receptacle contacts 38, to further secure the adapter within the cavity 25. The lip 64 abuts the front face 15 of the RJ45 female receptacle 10 thus preventing any further motion of the adapter 50 into the cavity 25. FIG. 5 shows the adapter 50 resident within the RJ45 female receptacle 10.

With the adapter 50 inside the cavity 25, a portion of the female receptacle contacts 38 adjacent to the side walls 22, 24 abut the side walls 58, 60 of the adapter 50, such that the remaining female receptacle contacts 38 align with the RJ11 male plug contacts 74 to make contact and achieve electrical conductivity therebetween. As an example, a typical RJ45 female receptacle 12 comprises 8 contacts 38 designated $p_1$, $p_2$, $p_3$, $p_4$, $p_5$, $p_6$, $p_7$, $p_8$, where each contact pin is assigned a signal, such as a data RX signal, data TX signal, signal ground, or unused, while a typical 2-contact pin RJ11 male plug 53 has contacts 74 designated $q_1$, $q_2$, which are assigned a data RX signal and a data TX signal, respectively. Accordingly, contact $q_1$, $q_2$ are aligned with the corresponding contacts of the female receptacle 10 carrying the data RX signal and a data TX signal, such as contacts $p_4$ and $p_5$. In another example, the male plug is an RJ14 header 52 having 2 twisted-wire pairs 74 where a first pair $q_2$, $q_3$ carries a data RX signal and a data TX signal respectively, and a second pair $q_1$, $q_4$ carries another data RX signal and another data TX signal, respectively. Accordingly, the use of the adapter 50 provides proper mechanical alignment of the RJ14 male plug 52 or RJ11 male plug 53 inside a RJ45 female receptacle 10, including the desired electrical pin alignment. Similar to the RJ45 male plug 12, the smaller-dimensioned RJ-type male plug, such as an RJ14 plug 52 or an RJ11 plug 53, generally includes a dielectric housing 76 having a free end or front face 78 for insertion into the opening 62 of the adapter 50, a resilient locking tab 80 integrally connected by a flexible hinge to the free end 78 of the dielectric housing 76 and extending obliquely rearwardly therefrom. The resilient locking tab 80 engages with the bottom wall 56 of the adapter 50 and maintains the smaller-dimensioned RJ-type male plug 52 or 53 within the adapter 50 and the cavity 25.

Advantageously, the adapter 50 decreases product component costs by obviating the need for multiple connectors having mutually exclusive pin requirements. The adapter 50 also permits physically different interface headers to connect to a common connector (e.g. RJ11 header connects into an RJ45 connector). The adapter 50 allows a specific connector to support a different/smaller interface header by providing proper mechanical alignment of the smaller/different header inside a connector, and proper electrical pin alignment of the smaller/different header inside the connector.

In another embodiment, the adapter 50 is integrated into a receptacle.

In yet another embodiment, the adapter 50 is integrated into the final product, or pre-installed in the product such that no separate piece is required.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The preceding detailed description is presented for purposes of illustration only and not of limitation, and the scope of the invention is defined by the preceding description, and with respect to the attached claims.

The embodiments of the invention in which an exclusive property or privilege is claimed are defined as follows:

1. A communication interface adapter having:

a top wall, bottom wall, opposing walls defining an adapter opening;

a lip extending from said top wall;

a tab extending from each of said opposing side walls; and a pair of arms extending from said opposing side walls and adjacent to said top wall;

wherein said opposing side walls convert an opening in a receptacle from a first connector type to a second connector type when inserted into said opening.

2. The adapter of claim 1, wherein said opposing side walls reduce a size of said opening in said receptacle from a first connector size to a second connector size when inserted into said opening.

3. The adapter of claim 1, wherein said opposing side walls abut a first portion of contacts within said opening in said receptacle and align a second portion of contacts within said opening in said receptacle with plug contacts of a connector of said second connector type.

4. The adapter of claim 1 wherein said lip is positioned about the middle of the opposing side walls of said receptacle.

5. The adapter of claim 1 wherein said arms resiliently anchor said adapter within a keyway of said receptacle.

6. The adapter of claim 1 wherein said receptacle receives and is electrically coupled with a first registered jack (RJ)-type connector, and receives said adapter and is electrically coupled with a second RJ-type connector within said adapter when said adapter and second RJ-type connector is inserted into said opening in said receptacle.

7. The adapter of claim 6 wherein when said second RJ-type connector is within said adapter, the pin-out specification of said second RJ-type connector correspond to the pin-out specification on the first RJ-type female receptacle with a corresponding signal.

8. The adapter of claim 7 wherein said adapter is dimensioned such that pins of said second RJ-type connector are electrically coupled to corresponding pins of said first RJ-type female receptacle.

9. The adapter of claim 8 wherein said first RJ-type connector and said second RJ-type connector are chosen from one the following RJ-type connectors: RJ2MB, RJ11(C/W), RJ12(C/W), RJ13(C/W), RJ14(C/W) RJ15C, RJ18(C/W) RJ21X, RJ25(C/W), RJ26X, RJ27X, RJ31 X, RJ32X, RJ33X, RJ34X, RJ35X, RJ38X, RJ41S, RJ45S, RJ48C, RJ48S, RJ48X, RJ49C, RJ61X, and RJ71C.

10. The adapter of claim 9 wherein said receptacle receives a RJ45 connector.

11. The adapter of claim 10 wherein said receptacle receives a RJ11 connector when said adapter is inserted into said opening in said receptacle.

12. The adapter of claim 9 wherein said adapter is integrated with said first RJ-type receptacle.

13. An apparatus for use with a first RJ-type female receptacle having a plug receiving end with an internal cavity, said first RJ-type female receptacle designed to receive a corresponding first modular mating RJ-type male plug, said apparatus received in said first RJ-type female receptacle, said apparatus having:

a housing having a front face, a top wall, a bottom wall and side walls defining an opening formed within said front face; and said apparatus received in said first RJ-type female receptacle converting said first RJ-type female receptacle to a second RJ-type female receptacle, said opening dimensioned to receive a second modular mating RJ-type male plug, wherein said second modular mating RJ-type male plug is dimensioned smaller than said first modular mating RJ-type male plug.

14. The apparatus of claim 13 wherein when said apparatus is inserted into said first RJ-type female receptacle, contact pins on said modular mating second RJ-type male plug are aligned with contact pins on said first RJ-type female receptacle to achieve electrical conductivity.

15. A method of coupling a first RJ-type female receptacle of a first size and a second RJ-type connector of a second size, wherein said first RJ-type female receptacle and second RJ-type connector correspond to different communication interface, the method comprising the steps of:

providing a communication interface adapter received within said first RJ-type female receptacle;

anchoring said communication interface adapter within a keyway of said first RJ-type female receptacle; said communication interface adapter providing a desired mechanical alignment and electrical pin alignment of said second RJ-type connector within said first RJ-type female receptacle.

16. The method of claim 15, wherein said communication interface adapter is dimensioned such that pins of said second RJ-type connector are electrically coupled to corresponding pins of said first RJ-type female receptacle.

17. The method of claim 16, wherein said communication interface adapter is dimensioned to adapt said first RJ-type female receptacle to a second RJ-type female receptacle to receive said second RJ-type connector.

18. The method of claim 17, wherein said communication interface adapter comprises:

a top wall, bottom wall, opposing walls defining an opening;

a lip extending from said top wall;

a tab extending from each of said opposing side walls; and a pair of arms extending from said opposing side walls and adjacent to said top wall.

19. The method of claim 18, wherein said lip and said tabs abut a front face of said first RJ-type receptacle, and said arms anchor said adapter within a keyway of said first RJ-type receptacle.

20. The method of claim 19, wherein said first RJ-type connector and said second RJ-type connector are chosen from one the following RJ-type connectors: RJ2MB, RJ11(C/W), RJ12(C/W), RJ13(C/W), RJ14(C/W), RJ15C, RJ18(C/W), RJ21X, RJ25(C/W), RJ26X, RJ27X, RJ31X, RJ32X, RJ33X, RJ34X, RJ35X, RJ38X, RJ41S, RJ45S, RJ48C, RJ48S, RJ48X, RJ49C, RJ61X, AND RJ71C.

* * * * *